US005263297A

United States Patent [19]

Kim

[11] Patent Number: 5,263,297

[45] Date of Patent: Nov. 23, 1993

[54] STRUCTURAL MEMBER WITH A METAL SHELL

[76] Inventor: Joong S. Kim, #245-402 Jugong 3rd Apartment, Kwachon, Kyunggi-do, Rep. of Korea

[21] Appl. No.: 777,618

[22] Filed: Oct. 16, 1991

Related U.S. Application Data

[63] Continuation-in-part of Ser. No. 608,369, Nov. 2, 1990, abandoned.

[30] Foreign Application Priority Data

Nov. 2, 1989 [KR] Rep. of Korea ..... 1989-15859

[51] Int. Cl.[5] ..... E04C 3/00

[52] U.S. Cl. ..... 52/724; 52/725; 52/726.2; 52/726.3; 52/244; 52/423; 52/301

[58] Field of Search ..... 52/721-728, 52/244, 227, 260, 301, 309.17, 601, 707, 423

[56] References Cited

U.S. PATENT DOCUMENTS

| | | | |
|---|---|---|---|
| 820,156 | 5/1906 | Tresidder | 52/725 X |
| 836,673 | 11/1906 | Ford | 52/725 |
| 1,489,742 | 4/1924 | Davenhall | 52/244 |
| 1,971,051 | 8/1934 | Reiner et al. | 52/725 X |
| 2,099,470 | 11/1937 | Coddington | 52/724 X |
| 2,210,553 | 8/1940 | Miller | 52/722 X |
| 2,874,546 | 2/1959 | Fox | 52/726 |
| 3,333,808 | 8/1967 | Du Boff | 52/726 |
| 3,501,881 | 3/1970 | Van Buren | 52/723 X |
| 3,810,337 | 5/1974 | Pollard | 52/223 R |
| 3,858,374 | 1/1975 | Ben-Zvi | 52/724 X |
| 4,694,622 | 9/1987 | Richard | 52/309.17 X |
| 4,910,940 | 3/1990 | Grady, II | 52/726 |

FOREIGN PATENT DOCUMENTS

| | | | |
|---|---|---|---|
| 0145171 | 2/1952 | Australia | 52/725 |
| 0537658 | 1/1956 | Italy | 52/725 |
| 0580292 | 11/1977 | U.S.S.R. | 52/724 |

*Primary Examiner*—Carl D. Friedman
*Assistant Examiner*—Robert Canfield
*Attorney, Agent, or Firm*—Sterne, Kessler, Goldstein & Fox

[57] ABSTRACT

A structural member comprises an elongated hollow thin metal shell and a concrete filler moulded into the hollow thin metal shell. A pair of reinforcing end pieces is engaged in both ends of the shell and is embedded in the concrete filler in order to prevent both ends of the shell from deforming in the process of injecting concrete mortar into the shell and to prevent both end portions of the structural member from rupturing or breaking during transportation or construction thereof.

6 Claims, 5 Drawing Sheets

STRUCTURAL MEMBER WITH A METAL SHELL

CROSS REFERENCE TO THE RELATED APPLICATION

This application is a continuation-in-part of application Ser. No. 07/608,369, filed Nov. 2, 1990, now abandoned, the specification and claims of which are incorporated herein by reference.

BACKGROUND OF THE INVENTION

1. Field of the Invention

The present invention relates to a structural member with a metal shell and a method of making the same; and, more particularly, to a novel structural member fabricated by injecting concrete mortar into an elongated hollow thin metal shell, which is adapted to be used in combination with a base, a wall and other members.

2. Description of the Prior Art

In general, a structural member such as a pillar, column, post, pole, beam and the like is made of lumber, concrete, metal or their composites according to its appropriate use.

In particular, a structural member made of concrete has been widely used in the construction field because of its high compressive strength and economy. Also, it has an advantage that it can be easily made in various shapes by designing a diverse form of molds. However, such concrete columns and posts are not adapted to be employed in decorative articles due to their rough surfaces and poor appearances. Accordingly, additional finishing elements made of lumber and/or metal plates are required to refurbish the crude surfaces of the concerte members in order to employ them for sophisticated purposes.

Consequently, hollow metal structural members made of, e.g., aluminum, aluminum alloys, stainless steel, zinc plated steel, special steel, copper or copper alloys are increasingly employed in various structural members such as supporting columns, connecting bars, ornamental poles and the like because of their appearances, high corrosive resistance and easy workability. In such hollow metal members, relatively greater thickness is required to withstand a given load, thereby entailing a high material/manufacturing cost.

Therefore, there have been attempts made to reduce the thickness of such a hollow metal structure by way of forming in a section of the structure a bent or inwardly grooved shape and thereby increasing the bending strength and the moment of inertia of the metal structure. However, the manufacturing cost of such metal member still remains relatively high because the formation of a particular shape in the metal member adds further manufacturing steps. In particular, since the relative thinness of the metal member makes it vulnerable to a sudden external force.

Accordingly, various structural members have been developed with the specific view of improving their tensile and compressive strength.

For example, U.S. Pat. No. 836,673 to A. W. Ford teaches a metal column filled with concrete therein, including reinforcing metal tubes placed in the column at its weakest or breaking points and embedded in the concrete. In U.S. Pat. Nos. 1,934,260 and 1,971,051, there are provided structural members comprising a concrete core, a metal shell enclosing the core and plates mounted in both ends of the core wherein the plates transmit and distribute compressed loads over the concrete core.

U.S. Pat. No. 3,468,090 to L. Hermite discloses a reinforced concrete structure which comprises a concrete core, and a continuous metal reinforcement surrounding the concrete core, a high strength adhesive interposed between the surfaces of the core and the reinforcement.

Although the concrete structural members disclosed in the above prior patents may have been useful for the intended purpose, a metal shell of greater thickness is needed to manufacture such structural members which are used in large constructional structures, thereby increasing the manufacturing cost.

In U.S. Pat. Nos. 2,874,546, 3,333,808 and 4,910,940, there are provided various devices for securing concrete structural columns or posts to a base. However, in such securing devices, substantial labor is required to assemble the parts due to their complicated structures.

SUMMARY OF THE INVENTION

Accordingly, it is an object of the present invention to provide a novel structural member with a thin shell made of metal or plastic, which is adapted to be used in combination with a base with ease.

It is another object of the present invention to provide a structural member with a thin metal shell, having reinforcing end pieces adapted for preventing the deformation of either end of the thin metal shell in the process of manufacturing the structural member and for minimizing or preventing the rupture and destruction in both end portions of the structural member during the course of, e.g., transporting or constructing.

It is still another object of the present invention to provide a structural member having coupling elements for attaching it to a base or other structural members.

It is a further object of the present invention to provide a structural member which can be manufactured at a relatively low cost by minimizing the thickness of a metal shell.

The above and other objects of the present invention are accomplished by providing a structural member which comprises:

- an elongated hollow thin metal shell adapted for receiving concrete therein;
- a pair of reinforcing end pieces engaged in both ends of the shell and having at least one through-hole for receiving concrete therein; and
- a filler of concrete moulded into the shell and the through-holes of the reinforcing end pieces.

Each of the end pieces may include a plurality of ribs integrally formed therein and traversing the through-holes and one or more threaded holes provided at each of the ribs and adapted to connect the structural member to a base or other members.

In accordance with the present invention, a structural member can be fabricated by:

- preparing an elongated hollow thin metal shell;
- engaging reinforcing end pieces having at least one through-hole in both ends of the shell;
- maintaining the shell assembled with the reinforcing end pieces in a supporting device;
- injecting concrete mortar into the shell via the through-hole(s) at one of the reinforcing end pieces and setting the concrete mortar in the shell; and
- removing the supporting device from the shell.

BRIEF DESCRIPTION OF THE DRAWINGS

The above and other objects and advantages of this invention will be apparent from the following description and accompanying drawings, wherein like numbers refer to like parts in different views.

DETAILED DESCRIPTION OF THE INVENTION

Figure 1:
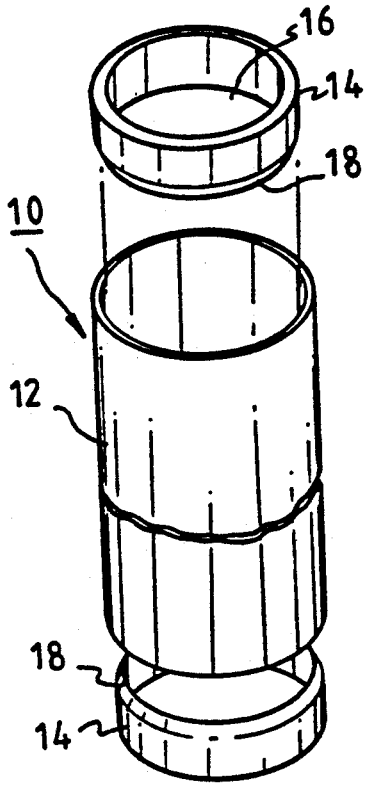
FIG. 1 is a partially exploded perspective view, with a filler of concrete removed for the sake of clarity, of a preferred structural member according to the invention and showing an elongated hollow thin shell and reinforcing end pieces designed to engage in both ends of the shell.
Figure 2:
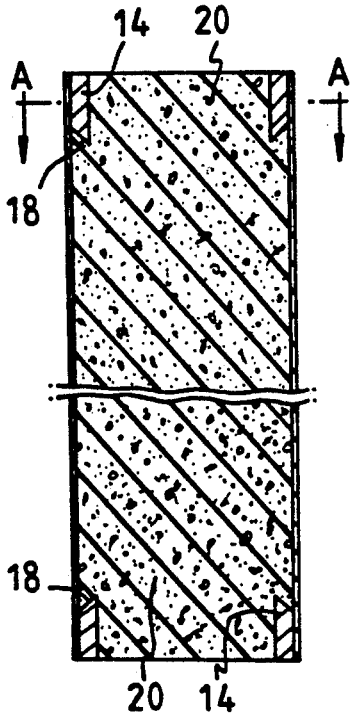
FIG. 2 is a vertical sectional view of the structural member of FIG. 1, fabricated in accordance with the invention.
Figure 3:
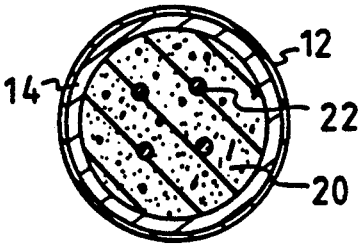
FIG. 3 is a sectional view taken along line A—A of FIG. 2.

Referring now to FIGS. 1 to 3, there is shown a structural member 10 according to a preferred embodiment of the present invention which comprises an elongated hollow thin shell 12, reinforcing end pieces 14 engaged in both ends of the hollow thin shell 12 and a filler of concrete 20 moulded into the shell 12.

In the structural member of the invention, the hollow thin shell 12 may be made of plastic or metal such as stainless steel, aluminium, copper or their respective alloys. It should be noted that the hollow shell 12 has a relatively thin thickness in order to reduce or minimize its manufacturing cost. The thickness of the shell 12 is preferably within the range of 0.2 mm to 2 mm and may be appropriately determined depending upon the diameter and use of the structural member 10. As described above, since the hollow shell 12 is relatively thin, it may be easily deformed, especially at its end portions. Accordingly, the reinforcing end pieces 14 are provided to prevent the deformation at both ends thereof as will be described more fully below.

Figure 11:
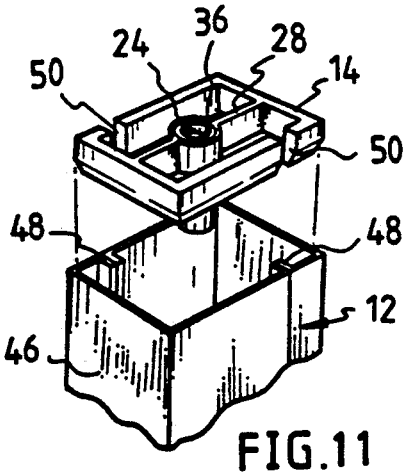
Figure 17:
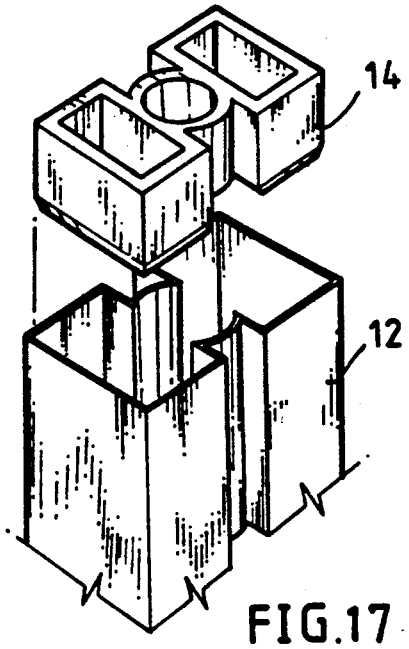
FIGS. 17 and 18 are partially exploded perspective views of various structural members, with parts and a filler of concrete removed for clarity, of the invention.
Figure 18:
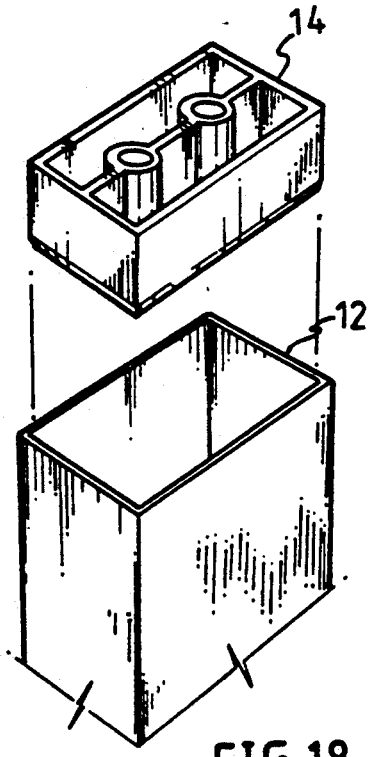

In this embodiment, although the structural member 10 is of a circular shape, it is not limited to this and may have various configurations(see FIGS. 11, 17 and 18).

The reinforcing end pieces 14 are designed to be tightly engaged in both ends of the hollow shell 12 and respectively have a through-hole 16 to facilitate the injection of concrete mortar into the hollow shell 12 therethrough in the manufacture of the structural member 10. In addition, provided around the outer periphery of the end piece 14 in an inward direction is a slightly tapered surface 18 which facilitates the insertion of the end piece 14 into the end of the hollow shell 12(see FIG. 1). The end pieces 14 may be bonded to the inner surfaces of the ends of the hollow shell 12 by an adhesive.

The end pieces 14 serve as a reinforcement preventing the deformation at the end sections of the hollow shell 12 during, e.g., the injection of concrete mortar therein and the rupture and destruction of the end sections of the finished structural member in the course of, e.g., transportation.

In this embodiment, although the end piece 14 is formed of a ring shape, it may have other forms compatible with that of the hollow shell 12. It is preferable that the end piece 16 is made of metal, a synthetic resin, or other plastic material.

As best shown in FIG. 2, filled and hardened in the hollow shell 12 is concrete as a filler 20. The filler 20 may be made of plastic concrete, mortar, artificial marble mortar, or ferro concrete. In general, the filler 20 serves to resist a load imposed on the structural member 10 and to withstand external shock exerted on the shell 12. In order to increase the compressive strength of the filler 20, preferably embedded in the filler 20 may be a plurality of reinforcing steel rods 22.

Figure 4:
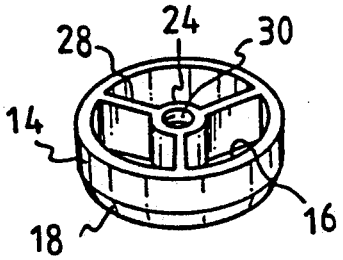
FIG. 4 is a perspective view of a reinforcing end piece with a coupling element suitable for coupling a structural member of the invention with a base or other members.
Figure 5:
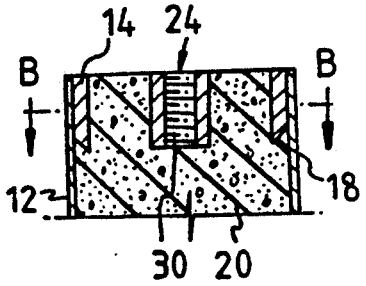
FIG. 5 is a partially vertical sectional view of another structural member incorporating the reinforcing end piece of FIG. 4.
Figure 6:
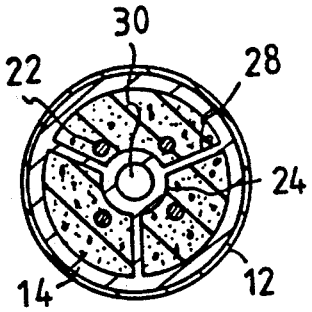
FIG. 6 is a sectional view taken along line B—B of FIG. 5.

FIGS. 4 to 6 show another preferred embodiment of the invention which is significant different from the first one.

As shown in FIG. 4, the reinforcing end piece 14 comprises a coupling means 24 adapted for coupling the structural member 10 with a base 26(shown in FIGS. 20 and 21), which includes a plurality of ribs 28 integrally formed therein and traversing the through-hole 16 and a threaded hole 30 provided at the central portion of the ribs 28. Consequently, the structural member 10 can be secured to the base 26 by engaging a bolt 32 in the threaded hole 30 through a bracket 74 mounted in the base 26(see FIGS. 20 and 21).

Figure 7:
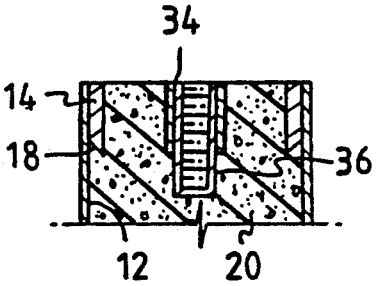
FIG. 7 is a view similar to that of FIG. 5 but illustrates an alternative coupling element engaged in one end of the shell and embedded in concrete.

An alternative embodiment similar to the one shown in FIG. 5 with the exception of the means for coupling the structural member 10 with the base 26 is shown in FIG. 7.

Figure 21:
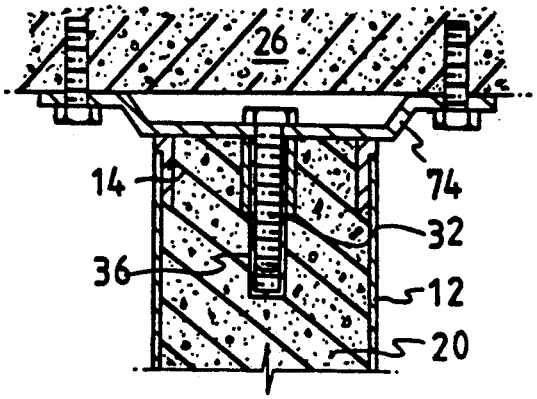

In this embodiment, the coupling means 24 includes an opening 34 formed in the central portion of the ribs 26 and a female thread 36 tightly engaged in the opening 34 and adapted to receive the bolt 32(FIG. 21). The female thread 36 is preferably embedded in the filler of concrete 20 through the opening 34 in order to stably maintain the attachment of the structural member 10 and the base 26.

Figure 8:
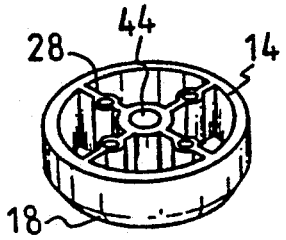
FIG. 8 is a perspective view of another reinforcing end piece with an aperture adapted for receiving a hollow pipe to be embedded in concrete.
Figure 9:
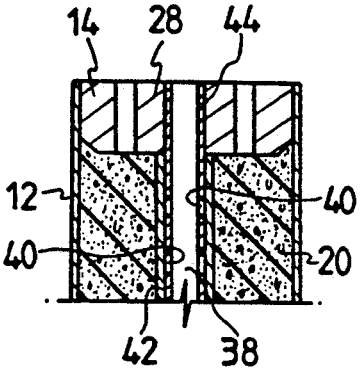
FIG. 9 is a partially vertical sectional view of another embodiment of the invention, incorporating the reinforcing end piece of FIG. 8.

FIGS. 8 and 9 show a modified structural member 10 of the present invention which is useful for receiving electrical wires or telecommunication cables(not shown).

In this embodiment, embedded in the concrete filler 20 of the structural member 10 is a hollow pipe 38 which can accommodate the electrical wires therein and which includes a plurality of apertures 40 to discharge surplus water in the concrete mortar injected into the shell 12 through the pipe 38. Preferably, partially wrapped around the outer surface of the hollow pipe 38 is a filter 42 such as a woven fabric, which can prevent the concrete mortar from penetrating through the apertures 40.

In addition, both end portions of the hollow pipe 38 are engaged in a hole 44 provided at the central portion of the ribs 28 of the reinforcing end pieces 14, respectively.

Figure 10:
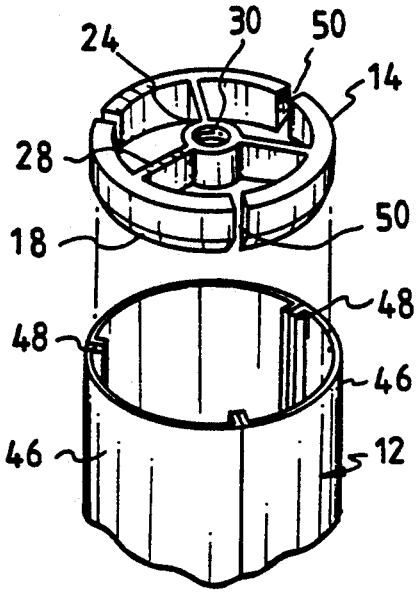
FIGS. 10 and 11 are partially exploded perspective views at modified structural members, with parts and a filler of concrete broken away for clarity, of the invention.

FIG. 10 shows another modified structural member 10 similar to the one shown in FIGS. 4 to 6. In this embodiment, the hollow thin shell 12 is made of a circular shape by welding inwardly bent flanges 48 of three curved thin plates 46. The end piece 14 is similar to the one shown in FIG. 4 but has slit portions 50 adapted to be engaged with the welded flanges 48 of the hollow shell 12.

FIG. 11 shows a further modified structural member 10 of the invention which is formed of a square shape, different from the circularly shaped structural member 10 of FIG. 10. In this preferred embodiment, the hollow shell 12 may be made of a square form by welding or bonding inwardly bent flanges 48 of appropriately preformed thin plates 46 in a similar way as described in the former embodiment (FIG. 10). The reinforcing end piece 14 also includes slit portions 50 complementary to the welded or bonded flanges 48 of the hollow shell 12 and is of a square shape substantially identical to that of the hollow shell 12. The coupling means 24 provided in the end piece 14 is the same as that described in connection with FIG. 7.

Figure 12:
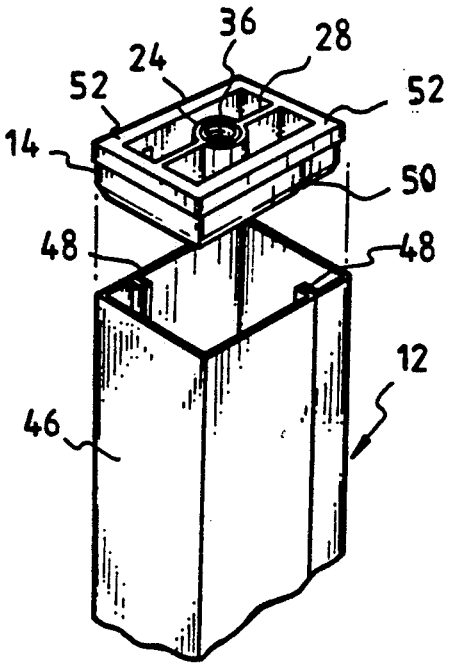
FIG. 12 shows a further modified structural member similar to that of FIG. 11.
Figure 14:
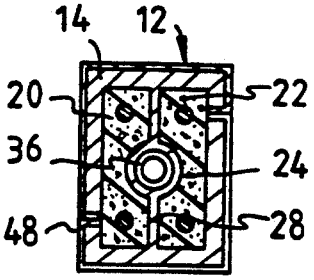
FIG. 14 is a sectional view taken along line C—C of the structural member shown in FIG. 13.
Figure 13:
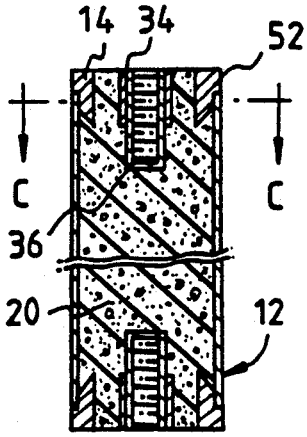
FIG. 13 is a vertical sectional view of the structural member of FIG. 12, having concrete moulded into the hollow shell.

In FIGS. 12 to 14, there is still provided a modified structural member 10 of the invention, which is fundamentally the same as the previous embodiment(FIG. 11) with the exception of the structure of the reinforcing end piece 14. In this embodiment, integrally formed on the outer periphery of the end piece 14 is a projecting flange 52 which can be seated on the end of the shell 12 when the end piece 14 is fully engaged with the shell 12. As best shown in FIG. 13, the outer periphery of the projecting flange 52 is preferably constructed to substantially lie coplanar with the outer surface of the hollow shell 12.

Figure 15:
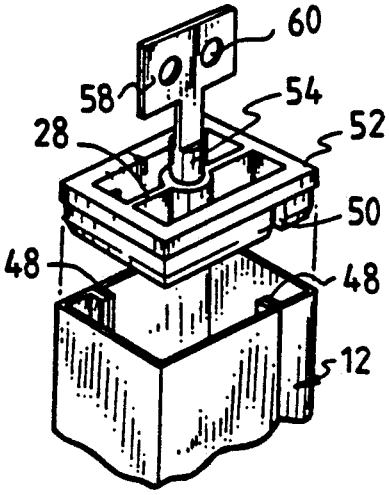
FIG. 15 is a view similar to FIG. 12 and illustrates an alternate coupling element associated with the reinforcing end piece.
Figure 16:
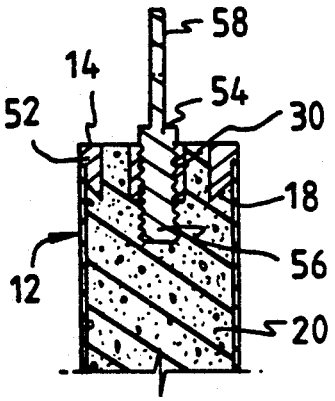
FIG. 16 is a partially vertical sectional view of the structural member with concrete moulded into the hollow shell as shown in FIG. 15.

The embodiment of FIGS. 15 and 16 is the same as that described with reference to FIGS. 12 to 14 with the exception that the end piece 14 has a bolt or anchor 54 engaged in the threaded hole 30 of the ribs 28 and extended outwardly therefrom instead of the female thread 36 engaged in the opening 34 thereof.

The lower portion 56 of the anchor 54 is embedded in the concrete filler 20. The outer extension 58 of the anchor 52 has at least one aperture 60 for providing the coupling of the structural member 10 and other members in a suitable manner.

In FIGS. 17 and 18, there are provided variant forms of the hollow shell 12 and the end piece 14 corresponding to the shell 12, with the concrete filler 20 being removed for the sake of clarity, according to other preferred embodiments of the invention.

Figure 19:
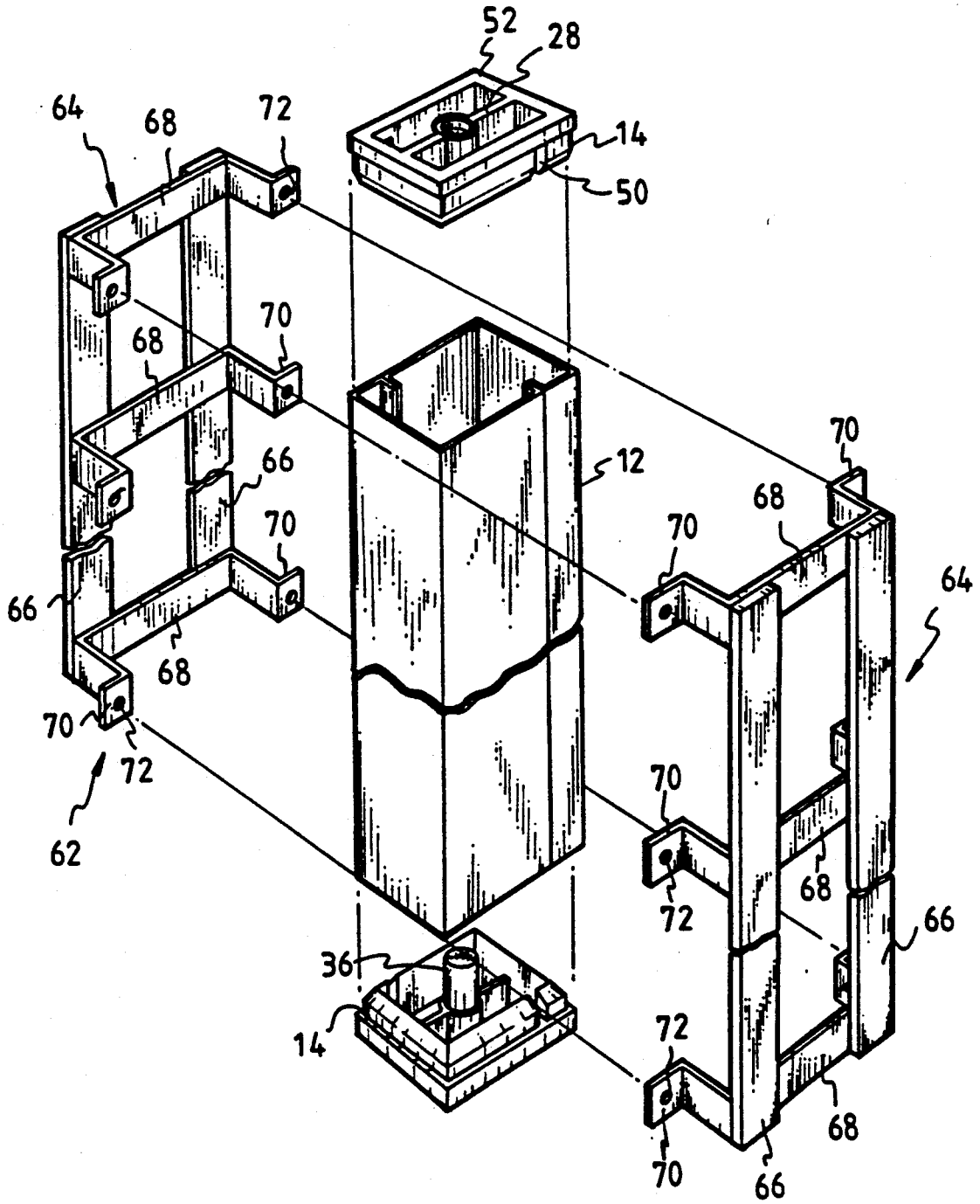
FIG. 19 is an exploded perspective view of a supporting device designed to prevent the deformation of an elongated hollow thin shell in fabricating the structural member shown in FIG. 13.

In FIG. 19, there is shown an exemplary supporting device 62 designed to be used in fabricating the structural member 10 of the invention as shown in FIGS. 12 to 14.

As described above, since the hollow shell 12 used in the invention is relatively thin in thickness, it may be deformed in the process of filling the concrete mortar inside the shell 12. Therefore, the supporting device 62 as shown in FIG. 19 is required to maintain the outer shape of the hollow shell 12 without deforming it while carrying out the filling work of concrete.

The device 62 comprises a pair of separable holders 64 for supporting the outer surface of the hollow shell 12. The respective holders 64 have a pair of spaced parallel frames 66 and a plurality of transverse members 68 spacedly secured to the frames 66 and having an appropriate shape corresponding to that of the hollow shell 12.

The respective transverse members 68 have flanges 70 outwardly extended from each of the end portions thereof in a perpendicular relationship and having holes 72 for receiving a bolt (not shown). Additionally, it is desirable to attach impulse-relieving pads(not shown) to the inner surfaces of the respective transverse members 68 in order to efficiently prevent the deformation of the hollow shell 12.

Therefore, in the fabrication of the structural member 10 according to the invention, the reinforcing end pieces 14 are inserted into both ends of the hollow shell 12 prior to the injection of the concrete mortar into the hollow shell 12. And then, the half holders 64 are oppositely disposed at the outer sides of the hollow shell 12, respectively, and assembled with each other by way of connecting the corresponding flanges 70 of the transverse members 68 by bolting. Accordingly, the transverse members 68 support the outer sides of the hollow shell 12 and, therefore, prevent the hollow shell 12 from deforming when the concrete mortar is poured into the shell 12.

Figure 20:
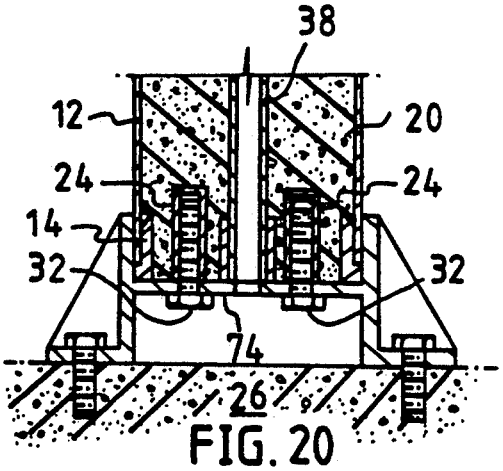
FIGS. 20 and 21 are partially vertical sectional views of the structural members of the invention secured to other members by way of employing coupling elements provided at the reinforcing end pieces.

FIGS. 20 and 21 show some exemplary embodiments of coupling the structural member 10 with a base in accordance with the invention.

As best illustrated in FIG. 20, the lower portion of the structural member 10 may be secured to a bracket 74 mounted in the base 26, by means of securing the bolt 32 into the threaded hole 30 through the bracket 74.

In addition, as alternatively shown in FIG. 21, the upper portion or both end portions of the structural member 10 may be attached to the bracket 74, e.g., in the above described way.

Although this invention has been shown and described with respect to the preferred embodiments, it will be understood by those skilled in the art that certain changes and modifications may be made without departing from the spirit and scope of the invention as defined in the following claims.

What is claimed is:

1. A structural member adapted to be used in combination with a base, which comprises:

an elongated hollow thin metal shell for receiving concrete therein, the shell having at least two plates welded together at inwardly bent flanges thereof;

a reinforcing end piece tightly engaged in an end of the shell, the reinforcing end piece having a through-hole suitable for receiving concrete, a plurality of ribs traversing the through-hole, slit portions complementary to the inwardly bent welded flanges and means for coupling the structural member with the base; and a concrete filler moulded into said hollow thin metal shell and the through-hole of said reinforcing end piece.

2. The structural member of claim 1 wherein said coupling means has a threaded hole provided at a crossed central portion of the ribs.

3. The structural member of claim 1 wherein said coupling means has an opening provided at the central portion of the ribs and a female thread tightly engaged in the opening and partially embedded in the concrete filler.

4. The structural member of claim 1 wherein said reinforcing end piece includes a projecting flange integrally formed on an outer periphery thereof and seated on the end of the shell.

5. The structural member of claim 4 wherein said coupling means has an opening provided at the central portion of the ribs and a female thread tightly engaged in the opening and partially embedded in the concrete filler.

6. A structural member adapted to be used in combination with a base, which comprises:

an elongated hollow thin metal shell for receiving concrete therein;

a reinforcing end piece engaged in an end of the shell, the reinforcing end piece having a through-hole suitable for receiving concrete, a plurality of ribs traversing the through-hole, and an opening provided at a crossed central portion of the ribs;

a concrete filler moulded into said hollow thin metal shell and the through-hole of said reinforcing end piece;

a hollow pipe for receiving electrical wires, telecommunication cables and the like, said hollow pipe being embedded in the concrete filler and engaged in the opening of said reinforcing end piece, said hollow pipe having a plurality of apertures for discharging surplus water in the concrete filler in fabricating the structural member and being wrapped with a filter around its outer surface for preventing the concrete filler from passing through the apertures.

* * * * *